US008460482B2

(12) United States Patent
Tanimoto et al.

(10) Patent No.: US 8,460,482 B2
(45) Date of Patent: Jun. 11, 2013

(54) HEAT-RESISTANT ALLOY SPRING AND NI-BASED ALLOY WIRE THEREFOR

(75) Inventors: Yoshinori Tanimoto, Hirakata (JP); Naoyuki Kawahata, Hirakata (JP); Shoji Ichikawa, Nagoya (JP); Hiroyuki Shiga, Nagoya (JP)

(73) Assignees: Nippon Seisen Co., Ltd., Osaka-shi (JP); Chuo Spring Co., Ltd., Nagoya-shi (JP)

( * ) Notice: Subject to any disclaimer, the term of this patent is extended or adjusted under 35 U.S.C. 154(b) by 1276 days.

(21) Appl. No.: 11/902,655

(22) Filed: Sep. 24, 2007

(65) Prior Publication Data

US 2008/0166258 A1 Jul. 10, 2008

(30) Foreign Application Priority Data

Sep. 25, 2006 (JP) ..... 2006-259282

(51) Int. Cl.
*C22C 19/05* (2006.01)

(52) U.S. Cl.
USPC ..... 148/410; 420/448; 420/449; 420/450; 148/428

(58) Field of Classification Search
USPC ..... 148/410, 428; 420/448, 449, 450
See application file for complete search history.

(56) References Cited

U.S. PATENT DOCUMENTS

| | | | | |
|---|---|---|---|---|
| 4,798,632 | A * | 1/1989 | Yonezawa et al. | 148/675 |
| 4,833,041 | A * | 5/1989 | McComas | 428/610 |
| 6,918,972 | B2 * | 7/2005 | Ueta et al. | 148/428 |

FOREIGN PATENT DOCUMENTS

| | | |
|---|---|---|
| JP | 2000/109955 | 4/2000 |
| JP | 2000/345268 A | 12/2000 |
| JP | 000371423 | 11/2002 |
| WO | WO-00/44950 | 3/2000 |

* cited by examiner

*Primary Examiner* — Jessee R. Roe
(74) *Attorney, Agent, or Firm* — Birch, Stewart, Kolasch & Birch, LLP

(57) ABSTRACT

A heat-resistant alloy spring is made of a Ni-based alloy material comprising in weight %: not more than 0.1% C; not more than 1.0% Si; not more than 1.50% Mn; 13.0 to 25.0% Cr; 1.5 to 7.0% Mo; 0.5 to 4.0% Ti; 0.1 to 3.0% Al; {at least one optional element selected from the group consisting of 0.15 to 2.50% W, 0.001 to 0.020% B, 0.01 to 0.3% Zr, 0.30 to 6.00% Nb, 5.0 to 18.0% Co, and 0.03 to 2.00% Cu}; the balance being essentially Ni; and incidental impurities. The Ni-based alloy material is provided in its crystal structure with gamma prime phase [$Ni_3$(Al, Ti)] or gamma prime phase [$Ni_3$(Al, Ti, Nb)].

8 Claims, 3 Drawing Sheets

×400

×200

50 μm

HEAT-RESISTANT ALLOY SPRING AND NI-BASED ALLOY WIRE THEREFOR

BACKGROUND OF THE INVENTION

The present invention relates to a heat-resistant alloy spring and a Ni-based alloy wire used therefor, which may be used suitably for apparatuses and devices used in high-temperature environments, e.g. pipe-switching valve inside a muffler in an exhaust system of an automobile engine, various heating furnaces and the like.

Heretofore, as metal alloy wires used for heat-resistant springs, stainless steel wires such as of SUS304, SUS631J1 and the like have been used on the ground of being comparatively inexpensive. The durable temperature thereof is however about 200 to 400 deg.C. at the highest.

Therefore, Ni-based alloy wires such as Inconel X750 and Inconel 718 have been widely used as heat-resistant alloy wires.

For example, "the anthology of preprints, pages 29-32, in the lecture presentation of the Japan society for spring Research in 1987 autumn" says that, as a result of a heat resisting property test at temperatures of from 450 to 500 deg.C., it was revealed that when compared with the spring of the conventional Inconel X750, the spring of Inconel 718 has about twice heat-resistance at an environmental temperature of 500 deg.C.

Thus, in the case of springs whose durable temperatures are about 500 deg.C. at the highest, there exist materials being relatively stable in the strength for the metal alloy wires used therefor. Accordingly, it is possible to make a choice from various materials in terms of material cost, workability, characteristics and the like.

In the case of various spring products used in for example engine exhaust systems such as of automobiles, aircrafts and the like, however, heat durability over the aforementioned temperature is required so as to be usable in high-temperature environments of over 600 deg.C. Further, there are necessitated such properties that the permanent set in thermal fatigue is less and the operating life is long even in the high-temperature environments.

For example, FIG. 3 shows a type of the muffler for an automobile engine. FIG. 3(A) shows the entire structure thereof in cross section. FIG. 3(B) is an enlarged view of a main part of an opening-and-closing valve thereof. The muffler 10 is provided in a metal casing 11 with separate chambers, in this example three chambers (A1 to A3). The chambers (A1 to A3) are communicated with each other through pipes (P1 to P4). The exhaust gas G fed thereinto from the pipe (inlet pipe) P1 flows in the respective chambers as indicated by arrows in the figure, and finally discharged from the pipe (exhaust pipe) P4. As shown in FIG. 3(B), the above-mentioned heat-resistant spring S is used as a spring for pressing a lid 13 of the opening-and-closing valve 12 disposed (within the chamber A1) at an end of the pipe P2. In this example, through an open end B2 and side holes B1 of the inlet pipe P1, the exhaust gas G fills the chambers A2 and A3. up to a certain feed rate, the filling gas G flows out into the chamber A1 and is discharged from the exhaust pipe P4. But, when the feed rate becomes over a preset value, the opening-and-closing valve 12 opens, and the pipe P2 becomes a bypass channel. Spring property of the spring S is adjusted according to the opening-and-closing valve 12.

The exhaust gas G fed into the muffler 10 is high-temperature gas combusted in the engine. In consequence, the above-mentioned spring s is required to have a heat resistance enabling to withstand such high temperatures and the spring performance enabling to maintain the preset value of the feed rate of the exhaust gas G. Further, the thermal fatigue rate is required to be small sodas to restrain the occurrence of permanent set in thermal fatigue by withstanding the heat. And also, a longer operating life is necessitated.

The "thermal fatigue rate" means the value obtained by: deforming a spring by applying a prescribed stress; obtaining the load P1 of the spring at the time; exposing the spring, with keeping the deformed state (h), to a high-temperature environment for a predetermined time; releasing the spring thereafter; loading the spring and obtaining the load P2 by which the spring becomes the same deformed state (h) as before; dividing the decrease of the load (P1−P2) by the original load P1; and being expressed in percentage. This is also called load loss WS (%) and can be expressed in the following expression:

$$WS=\{(P1-P2)/P1\}\times 100.$$

In the case of a helical compression spring for example,

P1 is the load (N) of the spring at a height (h) corresponding to a striction strain of 600 MPa before exposed to high temperature, P2 is the load (N) at the spring height (h) after exposed to the high temperature.

Meanwhile, the smaller value Ws is better for the heat-resistant spring.

In connection with the heat-resistant springs for such a use, a heat-resistant Ni alloy wire comprising 0.01 to 0.40% C, 5.0 to 25.0% Cr and 0.2 to 8.0% Al; at least one constituent selected from among 1.0 to 18.0% Mo, 0.5 to 15.0% W, 0.5 to 5.0% Nb, 1.0 to 10.0% Ta, 0.1 to 5.0% Ti and 0.001 to 0.05% B; the balance being Ni which includes at least one constituent selected from among 3.0 to 20.0% Fe and 1.0 to 30.0% Co; and incidental impurities, have been proposed in Japanese Patent No. 3371423 (hereinafter referred to as Document 1). This heat-resistant Ni alloy wire is descried as being usable under such a condition that the durable temperature is 700 deg.C. or less because the tensile strength and crystal grains are controlled.

Further, Japanese Patent Application publication No. 2000-345268 (hereinafter referred to as Document 2) proposed that, in a Ni-based alloy wire having a composition similar to that of Document 1 but Zr is further added, the grain size number and surface roughness are specified. This is described as being possible to set the residual shearing strain below 0.3% at an environmental temperature of 700 deg.C.

Furthermore, a spring alloy has been proposed in Japanese Patent No. 3492531 (hereinafter referred to as Document 3) wherein, in a heat-resistant stainless steel, a weight ratio "{eta phase [$Ni_3$ Ti: hcp structure]/gamma prime phase [$Ni_3$ (Al, Ti, Nb)]}×100" of eta phase [$Ni_3$ Ti: hcp structure] precipitated at grain boundaries and gamma prime phase [$Ni_3$ (Al, Ti, Nb)] precipitated in matrix of gamma phase crystal grains is set in a range of from 0.01 to 10.00%. This gamma prime phase [$Ni_3$(Al, Ti, Nb)] is 1 to 20 nanometer spherical grains. The above-mentioned gamma phase means austenite.

Various recent devices are required to be downsized and to be high-performance. For example, in the case of the above-mentioned high-temperature spring used with a car engine or the exhaust system, it is required to be useable at environmental temperatures higher than ever (for example 700 to 800 deg.C.), without substantial deterioration of the spring properties and the mechanical strength. In such environmental temperatures, however, it is difficult to employ the above-mentioned hitherto-proposed heat resistant materials.

That is to say, the heat-resistant alloy wire in Document 1 is of a Ni-based alloy having been known as a high-temperature material such as Inconel X-750 and Inconel 718. The tensile strength, crystal grains and aspect ratio are defined within specific ranges, aiming at improvements in the properties. Moreover, an example in Document 1 is described as having a residual shearing strain of 0.3% at a compressive strain of 600 MPa and a temperature of 650 deg.C.×24 hours.

However, when that in Document 1 is used at temperatures higher than their operating temperature 650 deg.C., for example, that is used in a high-temperature environment of 700 deg.C., there is possibly that the residual shearing strain becomes larger and the operating life becomes shorten. Namely, even though it is explained with the example that the residual shearing strain at the environmental temperature of 650 deg.C. is 0.2 to 0.37%, it can not be said that Document 1 refers to the property under a temperature environment over 650 deg.C.

Further, in Document 1, the crystal grain diameter and the aspect ratio are defined, but, as to the criteria, there is no concrete explanation. Furthermore, regarding the composition, a broad range is given to the content of each element, therefore, it is presumable that the crystal structure and the state of the material become nonuniform. Therefore, the definition of the ranges for the crystal grain diameter and the aspect ratio do not make much sense.

Document 2 states that the heat resistance is relatively stable under an environmental temperature of 650 deg.C. similarly to that in Document 1. But, the shearing strain at 700 deg.C. is remarkably increased. Accordingly, it is presumed that a critical region of the characteristic change lies between these temperatures. But, optimum conditions in this region between these temperatures cannot easily be determined from the description of Document 2.

The above-mentioned Document 3 shows a wire of a stainless steel whose Ni content is 10 to 50 wt %—in the examples, 25 wt % and 35 wt %. In this case, it is presumable that a precipitation quantity of gamma prime phase [$Ni_3$(Al, Ti, Nb)] whose major component is Ni, will be relatively few. Even if the grain diameter becomes small, it is difficult to obtain a sufficient heat-resisting effect.

SUMMARY OF THE INVENTION

In the heat-resistant alloy wires of the above-mentioned Documents, as stated above, the durable temperatures stick at 650 deg.C. at the highest.

The present invention has attained completion based on a finding that it is effectual for further increasing the durable temperature to control the configurations of gamma prime phase [$Ni_3$(Al, Ti, Nb)], [$Ni_3$(Al, Ti)] formed in a Ni-based alloy crystal.

It is an object of the present invention to provide a heat-resistant alloy spring having a stable resistance to permanent set in thermal fatigue (referred to as "thermal fatigue performance") and resistance to oxidation, and a heat-resistant alloy wire as a Ni-based alloy wire used therefor.

According the present invention, the heat-resistant alloy spring is made of a Ni-based alloy material, the Ni-based alloy material comprises, in % in weight, not more than 0.1% C;

not more than 0.1% Si;

not more than 1.50% Mn;

13.0 to 25.0% Cr;

1.5 to 7.0% Mo;

0.5 to 4.0% Ti;

0.1 to 3.0% Al;

at least one optional element selected from the group consisting of 0.15 to 2.50% W, 0.001 to 0.020% B, 0.01 to 0.3% Zr, 0.30 to 6.00% Nb, 5.0 to 18.0% Co, 0.03 to 2.00% Cu;

the balance being essentially Ni; and incidental impurities, and in the Ni-based alloy material's crystal structure, gamma prime phase is formed.

The gamma prime phase is gamma prime phase [$Ni_3$(Al, Ti, Nb)] when Nb is included; when Nb is not included, the gamma prime phase is gamma prime phase [$Ni_3$(Al, Ti)]. The gamma prime phase has an average grain diameter (d) of not less than 25 nanometers, and a hardness-diameter ratio Hv/d between the average grain diameter (d) in nanometer and a Vickers hardness Hv of a position at a depth of one-fourth of the entire thickness or wire diameter from a surface of the Ni-based alloy material toward its center, is 5 to 25.

The reason for the measuring position of the Vickers hardness being at the depth of one-fourth from the surface of the Ni-based alloy material, is to normalize the measurements by eliminating hardness variations observed in a cross-section of a wire material or a strip material. The term "wire diameter" is used for the case of a wire material, and the term "thickness" is used for the case of a strip material. Although the different terms are used based on the difference between the cross-sectional shapes, the cross-sectional shape of the Ni-based alloy material in the present invention is not to be limited to certain shapes. It can be any shape, e.g. round shape, square shape, rectangle shape, other polygonal shapes and the like at will.

In this specification, therefore, the wire materials, strip materials and the like are generically referred to as "wire material" or "wire" for the sake of simplicity.

Moreover, according to the present invention, the Ni-based alloy wire used for the above-mentioned heat-resistant alloy spring is provided with a longitudinal elastic modulus in a range of from 150,000 to 230,000 N/sq.mm and an Hv hardness in a rang of from 320 to 480 by cold wiredrawing.

This Ni-based alloy-material comprises 13.0 to 25.0 wt % Cr and 1.5 to 7.0 wt % Mo; and at least Ti and Al are contained in order to improve the heat resistance. Mo and Al can increase a crystal lattice strain and control a steady state creep rate. By setting the weight percentages of these elements as above, solid-solution-hardening of the matrix is attempted. By precipitating out the gamma prime phase as being a Ni, Al and Ti intermetallic compound, it is further hardened, and the heat resistance and thermal fatigue performance are improved.

Consequently, the heat-resistant alloy spring becomes usable in even higher-temperature environments, and it becomes possible to expand the applications into a wide variety of applications under high temperature conditions.

In addition to such componential adjustments, there is precipitated out in the crystal structure the gamma prime which has an average grain diameter of not less than 25 nanometers, and renders the ratio Hv/d of this average grain diameter (d) and the Vickers hardness Hv at the predetermined depth being 5 to 25. Thereby, the movement of dislocation occurred when the material is deformed is effectively prevented, and the rigidity and elasticity are heightened, and the thermal fatigue performance is improved.

If the average grain diameter is set in a proper range of from 30 to 80 nanometers, at the time the gamma prime resists against the movement of dislocation, the bypass mechanism is restrained, and the performance can be heightened. Further, by an ageing heat treatment, the spring properties can be stabilized and suitably used as the spring for adjusting the exhaust valve of the automobile engine for which a long operating life and high-performance are required.

In the Ni-based alloy wire used as the heat-resistant alloy spring, by carrying out the above-mentioned process of cold wiredrawing, variation of quality during a subsequent springing (coiling) process can be restrained. Further, the prescribed gamma prime phase is easily formed during the aging heat treatment carried out after the springing process, and a high-quality heat-resistant spring can be provided.

Furthermore, having high hardness and high elastic modulus, the spring excels in the elastic property at high-temperature conditions, spring quality and manufacturing yield rate.

Still furthermore, unnecessary carbide, nitride, oxide and the like can be prevented from being precipitated, so it is possible to provide the alloy wire for spring which is excellent in homogeneity.

Moreover, a Ni coating layer is formed on the surface, thereby it is possible to provide lubrication for various processes such as of springing. The Ni coating layer on the surface has a concentration gradient in which the Ni component becomes lessened toward the inside, therefore, the Ni coat bonds with the inside alloy by diffusion, thus problems such as separation of the coat and cracks can be solved.

DESCRIPTION OF THE PREFERRED EMBODIMENTS

A heat-resistant alloy spring 1 is made of a Ni-based alloy material whose main component is Ni.

Figure 3A:
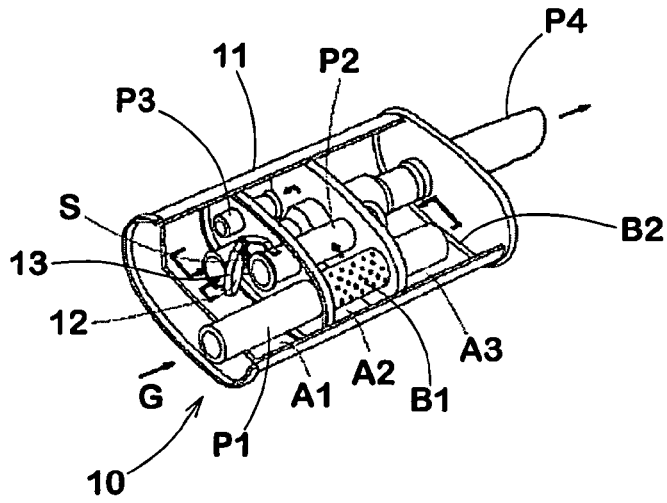
FIG. 3(A) is an exploded perspective view showing a muffler structure of an automobile exhaust system as an exemplary use of the heat-resistant spring.
Figure 3B:
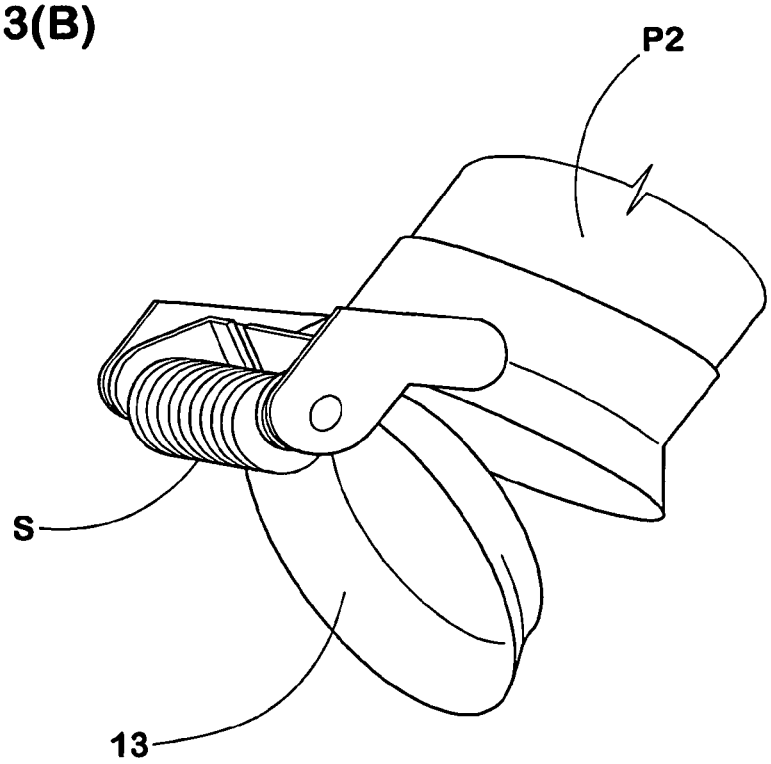
FIG. 3(B) is a perspective view showing an example of the opening-and-closing valve thereof.

The spring is used as a coil spring S for high-temperature environments, which can bias, toward the closing direction, a lid 13 of an opening-and-closing valve 12 in an engine exhaust muffler 10 shown in FIGS. 3(A) and 3(B) as an example wherein the spring is a torsion-type coil spring.

The above-mentioned Ni-based alloy material is a wire material made of a Ni-based alloy and having a substantially constant cross-sectional shape along the length thereof. In this example, the cross-sectional shape is circular.

The Ni-based alloy comprises in weight %: not more than 0.1% C; not more than 0.1% Si; not more than 1.50% Mn; 13.0 to 25.0% Cr; 1.5 to 7.0% Mo; 0.5 to 4.0% Ti; 0.1 to 3.0% Al; {at least one optional element selected from the group consisting of 0.15 to 2.50% w, 0.001 to 0.020% B, 0.01 to 0.3% Zr, 0.30 to 6.00% Nb, 5.0 to 18.0% Co, 0.03 to 2.00% Cu}; the balance being essentially Ni; and incidental impurities.

The Ni-based alloy material of the heat-resistant alloy spring 1 has a crystal structure in which gamma prime phase [$Ni_3$(Al, Ti, Nb)] or [$Ni_3$(Al, Ti)] is formed so as to improve the heat-resistance.

Describing the elements constituting the Ni-based alloy material, 13.0 to 25.0% Cr is included from the viewpoint of the heat-resistance and spring property in particular. And elements for heat resistance such as Mo, Ti and Al are added.

In the above-mentioned composition, c is added as an element for solid-solution-hardening to increase the strength. But an excessive addition is not preferable because it incurs precipitation of carbides and the like, therefore, the additive ratio is set to be not more than 0.1 desirably not more than 0.08%.

Si and Mn are both added as deoxidizer. But, an excess addition is undesirable because the productivity is decreased, therefore, Si is not more than 1.0%, and Mn is not more than 1.05%, preferably each is set to be not more than 0.50%.

Cr is a very important element in this heat-resistant Ni-based alloy, and it is essential for obtaining the oxidation resistance. In order to obtain a sufficient oxidation resistance, it is necessary to added at least 13.0% Cr. But an excess addition unfavorably incurs decline of a hot processing property, therefore, the upper limit is set at 25.0%, more preferable is 16.00 to 22.00%.

Co can increase the strength and durable temperature of the alloy by its addition, but because of the very costly element, an excess addition increases the cost. Therefore, in case of addition, the additive ratio is set to be 5 to 18%, preferably 11.00 to 14.00%.

W and Mo are elements for solid-solution-hardening to heighten the heat resistance. In order to improve the creep property at especially high temperatures, it is preferred to add 0.15 to 2.50% w and 1.5 to 7.0% Mo. But, an excess addition increases the cost, therefore it is preferable that w is 0.50 to 2.50%, and Mo is 5.00 to 7.00%.

Al and Ti are extremely important elements in the present invention to precipitate gamma prime phase [$Ni_3$(Ti, Al)] during the aging treatment after the springing process, thereby to improve the heat resistance drastically. If, however, each is excessively added, carbide and nitride are produced easily, thereby becoming defective. Thus, 0.1 to 3.0% Al and 0.5 to 4.0% Ti are added.

It is also preferable that 0.30 to 6.00% Nb is added so as to initiate the formation of gamma prime phase [$Ni_3$(Ti, Al, Nb)].

Ni is the main component of the gamma prime. Thus, it is desirable that the content thereof is more than 50% at the least.

Cu can improve the wiredrawing workability by its addition. But from the viewpoint of the strength of the spring, an excess addition is not preferable. Therefore, in case of addition, the additive ratio is set to be 0.03 to 2.00%.

An addition of Zr and/or B is preferable in order to heighten the creep rupture strength of the material and to obtain hot rolling workability. When these elements are not added, the hot rolling workability decreases, and defects such as clacks and checks during rolling are developed easily, and it becomes difficult to obtain the wire material effectively. Even if the wire material is obtained, breakages and the like are liable to occur during coiling process thereafter or during use. Therefore, in order to ensure the long-term reliability of the spring, it is desirable to add for example 0.001 to 0.020% B and/or 0.01 to 0.3% Zr.

As to the other impurities, when at least one of Ca, Mg, No, O and H is included, it is effective to adjust Ca to not more than 0.05, Mg to not more than 0.05%, N to not more than 0.10%, O to not more than 0.10%, and H to not more than 0.01%, from the viewpoint of reducing precipitation of carbide, nitride, oxide or the like, and improving the formation of the intermetallic gamma prime phase accompanying therewith.

Aside from those elements, each of P and S is preferably controlled to be about 0.010% or less similarly to in the general metallic materials.

As to Fe, a content of not more than 5.00% may be tolerated in this invention because it is difficult to completely eliminate Fe bonding with other elements.

Consequently, in the heat-resistant alloy spring according to the present invention, the intermetallic gamma prime phase of Ni is formed, and this gamma prime phase provides an effect of favorably preventing the movement of dislocation accompanying the deformation and an external force.

In the Ni-based alloy of the above-mentioned composition, owing to Mo and Al, the steady state creep rate can be reduced by the crystal lattice strain, and the solid-solution-hardening of the matrix can be attained. Thus, in the heat-resistant spring according to the present invention in which a large amount of gamma prime phase is formed, the heat resistance can be improved.

This effect can be achieved by setting the number of gamma prime phase occurred per a measuring unit area of 1.0 square micrometers to be not less than 100, for example about 100 to 10000 (wherein microscopic gamma prime whose grain diameter is less than 25 nanometers is excluded). Incidentally, the number can be counted by observing a target surface by the use of a 50000-power microscope, for example.

As described above, the gamma prime phase is formed in the alloy material as an intermetallic of Ni and Al or an intermetallic of Ni and Al and further Ti, Nb or the like, gamma prime phase [$Ni_3$(Al, Ti, Nb)].

Figure 1:
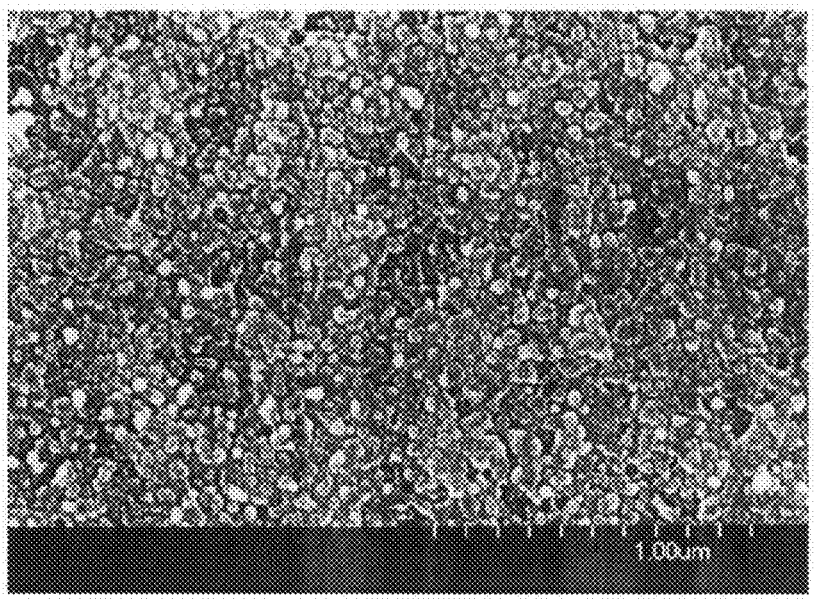
FIG. 1 is a micrograph showing a distribution of the formation of gamma prime phase at magnification 50000×.

For example, the gamma prime phase is a L12 (fcc-ordered) intermetallic based on $Ni_3Al$, and it has such a structure that Al atomic elements are at the vertices of a unit cubic, and Ni atomic elements are in face centers thereof. Thus, in comparison with alloy materials whose base metal is stainless steel or iron, a copious formation is possible, and as shown in FIG. 1 for example, the shape thereof becomes very small and it becomes toughened spherical grains. Therefore, by providing the gamma prime phase compactly in the crystal grains by adjusting to a proper size, the hardness of the alloy material itself can be heightened and the movement of dislocation can be prevented to improve the spring property.

Especially, the gamma prime phase is stable under high-temperature region in a constitutional diagram too, and the solid solubility in gamma phase (austenite phase) is high. Accordingly, gamma prime phase can be much precipitated. Even if much precipitated, since the ductility is high in comparison with other intermetallics, deterioration in ductility of the material itself can be inhibited.

Since the crystal structure is close to that of the gamma phase in the material, there is an advantage that the creep strength is hard to decrease for a long time. By combining the gamma prime phase [$Ni_3$(Al, Ti, Nb)] having such characteristic features, the heat-resistant property can be improved, and the applicability to heat-resistant springs can be increased.

More preferably, the Ni-based alloy comprises in weight %: not more than 0.08% C; not more than 0.50% Si; not more than 0.50% Mn; 16.00 to 22.00% Cr; 11.0 to 14.0% Co; 5.00 to 7.00% Mo; 2.50 to 4.00% Ti; 1.50 to 3.00% Al; and if necessary, at least one of 0.50 to 2.50% w, 0.001 to 0.020% B, and 0.01 to 0.30% Zr.

In the gamma prime phase [$Ni_3$(Al, Ti, Nb)] and the gamma prime phase [$Ni_3$(Al, Ti)], the average grain diameter (d) is not less than 25 nanometers. Further, the hardness-diameter ratio Hv/d of the average grain diameter (d) and the vickers hardness Hv at a position at a depth of one-fourth of the entire thickness or the wire diameter from a surface of the Ni-based alloy material toward its center, is 5 to 25 nanometers. Thereby, it is possible to achieve both of the fatigue resistance and the spring strength at high temperatures, and the mechanical properties for the springs can be improved. Further, the dislocation can be controlled.

As to the average grain diameter (d), according to the results of inventors' experiments, a material hardness increases along with an increase of the grain diameter of the above-mentioned precipitated gamma prime phase. However, there was found a phenomenon that the hardness decreases when the grain diameter is increased beyond about 100 nanometers. When the average grain diameter is less than 25 nanometers, the grains become too small unnecessarily, therefore, a sufficient effect to block the movement of dislocation can not be expected. When the grains become too large, contrary, even if these are gathered compactly, large gaps are formed therebetween so it becomes easy for the dislocation to protrude through the gaps (bypass phenomenon). Therefore, the average grain diameter (d) is not less than 25 nanometers, preferably from 30 to 100 nanometers, more preferably from 30 to 80 nanometers.

As shown in FIG. 1 for example, the grains are substantially spherical, therefore, by averaging grain diameters measured, the above-mentioned average grain diameter is obtained. In the measurement, a mean diameter of each of grains at randomly selected measuring points for example about 100 to 300 points, is obtained, then the mean diameters are averaged for the number of the measuring points.

Incidentally, the setting of the distribution density and grain diameter of the gamma prime phase is possible by adjusting the component ratio of the alloy material, conditions at the aging heat treatment stage such as temperature, time and ambient atmosphere and the like.

As shown in FIG. 1, the Ni-based alloy of the above-mentioned composition is in a state that many grains of proper sizes are in close formation.

In order to form the gamma prime phase, the heat-resistant spring is subjected to the aging heat treatment after forming. As to the conditions of the heat treatment, the temperature T is set to be not less than 1000 K, and the product of the temperature T(K) and a heating time t(Hr) is set in a range of from 1000 to 10000, preferably from 2000 to 8000 subjecting the heat treatment on these conditions, the mechanical properties of the alloy wire at the final wiredrawn state are not impaired and the properties can be improved.

Further, as mentioned above, the hardness-diameter ratio Hv/d is set to be 5 to 25. Thereby, it is possible to improve the resistance to dislocation and the resistance to fatigue. If the hardness-diameter ratio is less than 5, then the grain diameter of the gamma prime phase becomes enlarged more than necessary, and the spring strength decreases, and further the countervailing power against the dislocation decreases. If more than 25, on the other hand, as the grain diameter of the gamma prime phase is small, the range of the fatigue becomes wide and thus there is concern that the difference in the load between before and after use becomes large. More preferably, the hardness-diameter ratio Hv/d is set to be 8 to 20. And the Hv hardness of the heat-resistant alloy spring is set to be 400 to 550.

Meanwhile, this Hv hardness is measured at the position at one-fourth of the entire thickness thereof (the diameter thereof in the case of the wire material) from the surface of the surface layer of the alloy material toward the cross-sectional center.

A cut-off part of the wire material is implanted into a resin, and the cross-sectional surface is polished. Thereafter, on the cross-sectional surface, the measurement of the Vickers hardness and the measurement of the grain diameter with microscope observation are carried out. In the microscope observation, the cross-sectional surface is etched so that the crystal structure becomes visible and identifiable. For that purpose, for example, electrolytic etching can be employed, in which sulfuric acid and liquid methanol are used. Incidentally, the measurement is possible by the use of a field emission type scanning electron microscope (FE-SEM) of 50,000 to 100,000 magnifications for example.

In the heat-resistant alloy spring of the present invention, a twin crystal as shown in FIG. 2 may be formed in the crystal structure in addition to the above-mentioned gamma prime phase. Due to the multiple effect of the twin crystal and the gamma prime phase, the twin crystal can improve the properties of the heat-resistant alloy spring.

As to the twin crystal, for example, a recrystallization twin by annealing and a deformation twin by plastic forming, have been known.

In the case of the twin boundary, when compared with other grain boundaries, disorder of arrangement of atoms along the grain boundary is less and is structurally dense. Accordingly, the internal energy is low, and there are effects such that segregation of impurities, intergranular corrosion and fatigue are hard to occur. Thus, the present invention encompasses the utilization of the multiple effect of the properties of the twin crystal and the above-mentioned function of the gamma prime phase to hinder the movement of dislocation, in the heat-resistant alloy spring.

Figure 2A:
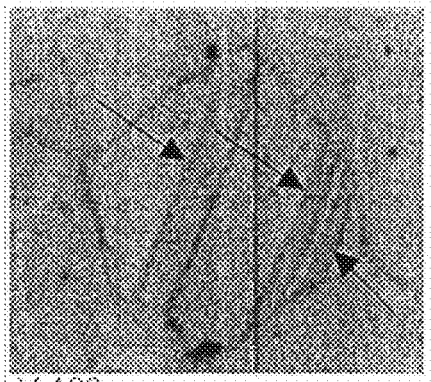
FIGS. 2(A) and 2(B) are micrographs showing twin crystals related to other feature than the present invention at magnification 400× and 200×, respectively.
Figure 2B:
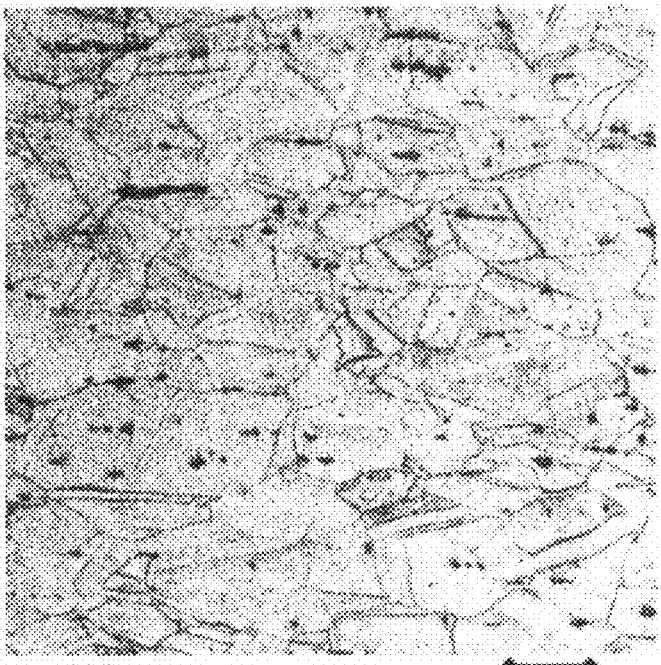

FIGS. 2(A) and 2(B) show a recrystallization twin; FIG. 2(A) is a structural photograph at magnification 400×, and FIG. 2(B) is that at magnification 200×.

Providing a large number of crystal grains with such twin structure, it becomes possible to utilize the structural strength of the twin in addition to the above-mentioned function of the gamma prime phase. Preferably, the total count Ns of crystal grains existing in the field of observation view, and the count NC of crystal grains having the twin structure are set to have a twin percentage Nc/Ns of not less than 30%, more preferably 50 to 95%. The twin percentage can be an averaged twin percentage which is obtained by calculating the twin percentage Nc/Ns for each of the fields of observation view at plural measuring points for example about 3 to 5 measuring points, and then averaging the plural values of Nc/Ns, or that obtained by calculating a total of the Ns values and a total of the Nc values about the plural measuring points, and then defining it by the total of the Nc values/the total of the Ns values.

Yet, the crystal grains to be counted are limited to those having grain diameters of not less than 10 micrometers. The reasons for this limitation are that: in the surface observed by the microscope, there are randomly and independently oriented crystal grains; thus there are grins whose various parts are observed, e.g. a grin whose central part is observed, a grin whose end part is observed and the like; furthermore, there is a grain being not a round shape; and it was known that limiting to those having sizes of not less than 10 micrometers, results in stochastic closeness of actual incidence.

Meanwhile, the grain diameter of the crystal grain is meant for, on the measuring surface, a minimum diameter or a minimum distance between opposite sides in a case that the crystal cross-section is noncircular.

In order to observe the grain diameter of the twin crystal, for example, the cut surface of the alloy material to be observed is, after mirror polished, subjected to a corrosion treatment by etching to thereby make it visible by its embossment. Then, it is observed by the use of an about 100 to 400 times power microscope. As to the etching, to dip it in an etching solution comprising ethanol, hydrochloric acid and cupric chloride is easily practicable and thus preferable.

The twin percentage NC/NS can be set by adjusting the balance in composition of the components of the alloy making up the spring, and the conditions at various heat treatments (e.g. the solid solution heat treatment) during processing.

In order to precipitate the above-mentioned gamma prime phase, usually the above-mentioned aging heat treatment is carried put after forming into the spring.

Before carrying out a springing process into the heat-resistant spring (in this example, before coiling), the above-mentioned Ni-based alloy is thinned, while making heat treatments and cold wiredrawing processes repeatedly. The finished wire diameter is, for example, not more than 4 mm (0.2 to 4 mm).

In the wiredrawing processes, the final rate of work is 20 to 60%, preferable 30 to 45%. Usually, in order to work-harden the Ni-based alloy to thereby heighten the mechanical properties, the rate of work is set to be large. However, if the rate of work is too large, the springing workability decreases and the rate of fatigue during use becomes large, so a large rate of work is not proper; therefore it is set in the above-mentioned range. Meanwhile, as to each wiredrawing process carried out in the middle stage, the rate of work is set in a range of form 10 to 70%.

Through the above-mentioned cold wiredrawing, the Ni-based alloy wire is provided with a Hv hardness of 320 to 480 and a longitudinal elastic modulus of 150,000 to 230,000 N/sq.mm; and it is provided with high-hardness and high-modulus characteristics for the spring material.

It is preferable that, before the above-mentioned wiredrawing processes or before the final wiredrawing process or after the final drawing process, a lubricant coating for example Ni plating is formed over the surface of the Ni-based alloy wire. Thereby, the above-mentioned wiredrawing processes and coiling process into the spring are facilitated, and the quality can be improved.

In order to form the above-mentioned twin crystal, the Ni-based alloy wire before subjected to the final wiredrawing (preferably, together with the Ni plating coating) is heated at a temperature of 900 to 1200 deg.C. for 10 to 1000 seconds, and then subjected to a solution heat treatment to cool down at a rate of 5 to 300 deg.C./sec.

Such solution treatment provides the wire material with the above-mentioned hardness and elastic modulus and actively generates twin crystals.

Thus, the cooling rate of the wire material during the final solution heat treatment affects the wiredrawing workability and the mechanical properties of the wiredrawn alloy wire, therefore it is preferably set to be 5 to 100 K/sec., more preferably 10 to 70 K/sec. Thereby it is possible to obtain a sufficient wiredrawing workability, a hardness and elastic modulus for the wire material, and a hardness after the process into the spring, and it is possible to generate the twin crystals.

If the cooling condition after the solution heat treatment is less than 5 K/sec., the incidence of the twin crystals is low, although there is a possibility that the hardness and elastic modulus are slightly increased.

In this way, the solution heat treatment before the final wiredrawing is carried out in advance of the above-mentioned aging heat treatment after the spring formation.

Moreover, for the wiredrawing and coiling, it is possible to provide the surface of the Ni-based alloy wire with a lubricant coating of inorganic salt, e.g. potassium, sodium or the like in addition to the Ni plating. Thereby, it is possible to reduce the friction with forming tools used in the subsequent coiling process, a process for bending an end and the like.

The Ni plating is made in a Nickel sulfamate bath for example, after the surface is subjected to pickling treatment with a mixed solution of hydrofluoric acid and nitric acid or a mixed solution of hydrofluoric acid and sulfuric acid. The thickness of the Ni plating is set to be about 2 to 15 micrometers.

The lubricant coating of the inorganic salt, e.g. potassium, sodium or the like can be used alone. But, it is also possible to use as a multilayer coating for example by forming on the above-mentioned Ni plating as an auxiliary lubricant.

As described above, it is preferable that these lubricant coatings are formed before the wiredrawing processes. Especially, in the case that the wire material being Ni plated before subjected to the final wiredrawing process is subjected to the solid solution heat treatment, since a concentration gradient of the Ni quantity occurs in the interface between the alloy wire and the plated layer, the bond therebetween is increased and the adhesiveness can be improved.

Further, during wiredrawing, the Ni plating layer is split in a scale-like manner, forming microscopic grooves therebetween. In the microscopic grooves, the above-mentioned auxiliary lubricant can be held, thereby bringing the higher lubricating performance.

In general, there can be used the auxiliary lubricant which comprises, as a major component, potassium sulfate, calcium sulfate or the like for example; and the quantity of the lubricant coating adhering onto the Ni plating is set to be about 0.05 to 4.0 g/sq.m.

After the wiredrawing processes, the Ni-based alloy wire is processed (coiled) into the heat-resistant alloy spring. To conform to this coiling process, a 0.2% proof strength of the Ni-based alloy wire is set to be 1200 to 1600 N/sq.mm. Therefore, the variation of quality of the spring forming can be controlled, and the prescribed elasticity in ultrahigh-temperature states can be provided.

Furthermore, the quality of the shape and manufacturing yield rate can be achieved. If the 0.2% proof strength is less than 1200 MPa, a sufficient spring property can not be obtained. If more than 1600 MPa, the springing workability becomes lowered; thus the above-mentioned range is defined. AS to the state of the surface after the wiredrawing processes, because of the Ni contained, it excels in the adhesion with the plate. The surface roughness Rz is set to be about 0.2 to 8.0 micrometers, preferably 0.3 to 0.6 micrometers for example.

By the way, in the case of the heat-resistant alloy spring 1 shown in FIG. 3(A) and FIG. 3(B), in order that the lid 13 can be opened when the supply pressure of the supplied exhaust gas G reaches to a predetermined pressure, the spring 1 is formed as a torsion-type coil spring of solid coiling which has a coil circle diameter (D) of not more than 40 mm, and a ratio (D/d) of the circle diameter (D) and a wire diameter d(mm) of 3 to 20 for example; and which is provided in both ends with straight portions opened at a predetermined angle so as to provide a mechanism that the lid is opened and closed by torsional stress at the straight portions.

Meanwhile, the type, shape and properties of the spring are not limited to the above. They can be defined freely according to the diameter of the pipe to be used with, installation conditions, magnitude of pressing force and the like. Although the spring in this example is used for an exhaust valve of automobile engine, this does not limit the use, shapes, and sizes of the heat-resistant alloy spring of the present invention.

[Examples of Ni-based Alloy Wire]

The present inventors took up Ni-based alloys having compositions shown in table 1 as Examples 1 to 17 and comparative examples 1 to 11.

Comparative examples 1 to 4 had compositions not meeting the requirements of the present invention.

Comparative examples 5 to 7 and comparative examples 8 to 10 had the same compositions as Examples 1 to 3, respectively, but, the conditions of the manufacturing processes were different.

Comparative example 11 had a composition of Inconel 718 corresponding to the above-mentioned prior document 1.

The components of each of the compositions were vacuum-molten and an ingot of 150 kg was prepared. Then by hot rolling the ingot, a wire rod having a diameter of 5.5 mm was made, and the rod was formed into an alloy wire having a diameter of 2.4 mm by making the cold wiredrawing and heat treating repeatedly and the final cold wiredrawing with a rate of work of 30%.

In the wiredrawing processes carried out in the middle stage, the rate of work was set in a range of form 10 to 70%.

In the case of Examples, before making the final wiredrawing process, the solution heat treatment was carried out by the use of a strand heat-treatment furnace, wherein the temperature was controlled within a range of from 1250 to 1450 K and the treatment time within a range of from 10 to 1000 seconds. Thereby, twin crystals were actively generated. Subsequently to the solution heat treatment, cooling was made in the conditions shown in Table 1. AS shown in Table 1, comparative examples included comparative example whose composition was changed and comparative example whose cooling condition was changed, although the same treatments as the Examples were made.

The Vickers hardness and the longitudinal elastic modulus were measured with respect to a sample of each of the wire materials subjected to the final wiredrawing, obtained in this way.

As to the vickers hardness, according to the Japanese Industrial standard z2244, the sample was implanted into a resin and a cut end surface was polished; on the cut end surface, the measurement was made at a test load of 2.492 N, at four measuring points inward from the surface by a one-fourth of the wire diameter; and the average value of the four points was employed as a measured value.

As to the longitudinal elastic modulus (N/sq.mm), a tensile test was carried out on the alloy wire, and the modulus was obtained by evaluating the expression E=sigma/epsilon (wherein, sigma: longitudinal stress N/sq.mm, epsilon: longitudinal strain)

based on the slope of an initial proportional part of the stress-strain curve. The results are shown in Table 1.

As to the wiredrawing workability of each of the wire materials, the wiredrawing and the like could be carried out without any problem in the case of each of Examples. However, in the case of comparative examples, some had a problem in the workability. For example in Comparative example 2, a crack was occurred in a part of the wire material during wiredrawing, and thus the yield rate declined.

Examples of the present invention each had a Hv hardness of 400 to 500 and a longitudinal elastic modulus of 150 to 230 KN/sq.mm.

Comparative examples 8 to 10 had the same components as the above-mentioned Examples 1 to 3 and Comparative examples 5 to 7, respectively; but the cooling condition after the solution heat treatment was set to be 2K/sec.; therefore, the hardness and the elastic modulus were slightly increased but the incidence of the twin crystals in this stage became low, which was confirmed by microscopy. Among Comparative examples, Comparative example 11 excelled in the heat-resistance.

TABLE 1

| | C | Si | Mn | Cr | Mo | Co | W | Al | Ti | Nb | B | Zr | Fe | Cu |
|---|---|---|---|---|---|---|---|---|---|---|---|---|---|---|
| Example 1 | 0.05 | 0.09 | 0.02 | 18.9 | 5.9 | 12.1 | 1.0 | 2.1 | 3.1 | | 0.006 | 0.03 | 0.4 | — |
| Example 2 | 0.04 | 0.12 | 0.05 | 19.2 | 6.2 | 13.2 | 1.1 | 2.2 | 2.9 | | 0.009 | — | 0.3 | — |
| Example 3 | 0.08 | 0.05 | 0.02 | 19.9 | 5.8 | 12.2 | 0.9 | 1.9 | 3.2 | | — | 0.06 | 0.4 | — |
| Example 4 | 0.01 | 0.13 | 0.04 | 18.8 | 5.7 | 12.8 | 1.0 | 2.2 | 2.9 | | 0.019 | 0.04 | 0.5 | — |
| Example 5 | 0.10 | 0.11 | 0.06 | 19.1 | 5.9 | 13.9 | 1.2 | 1.5 | 3.9 | | 0.008 | 0.06 | 0.1 | 0.02 |
| Example 6 | 0.06 | 0.10 | 0.03 | 18.5 | 7.0 | 12.0 | 1.2 | 1.9 | 2.5 | | — | 0.01 | 0.3 | — |
| Example 7 | 0.05 | 0.07 | 0.14 | 14.5 | 6.3 | 13.3 | 0.9 | 2.9 | 2.8 | | 0.007 | — | 0.2 | — |
| Example 8 | 0.03 | 0.12 | 0.05 | 16.3 | 6.1 | 12.7 | 0.8 | 1.9 | 2.9 | | 0.001 | 0.29 | 0.3 | — |
| Example 9 | 0.07 | 0.07 | 0.02 | 19.7 | 5.5 | 13.1 | 1.5 | 2.4 | 3.3 | | — | 0.03 | 0.4 | — |
| Example 10 | 0.03 | 0.14 | 0.05 | 13.1 | 5.4 | 13.6 | 1.4 | 2.1 | 3.0 | | 0.011 | — | 0.1 | — |
| Example 11 | 0.06 | 0.13 | 0.03 | 18.9 | 5.5 | 12.4 | — | 1.8 | 2.9 | — | — | — | — | 1.90 |
| Example 12 | 0.05 | 0.07 | 1.43 | 19.1 | 6.2 | 17.3 | 0.2 | 2.3 | 3.2 | | | 0.03 | — | — |
| Example 13 | 0.07 | 0.06 | 0.03 | 18.4 | 1.6 | 16.4 | 1.8 | 2.0 | 3.0 | 0.5 | — | — | 4.1 | — |
| Example 14 | 0.08 | 0.08 | 0.01 | 19.0 | 4.6 | 6.0 | 2.1 | 0.1 | 3.9 | | — | 0.03 | 0.1 | — |
| Example 15 | 0.03 | 0.91 | 0.03 | 16.4 | 5.1 | 12.8 | 1.1 | 2.9 | 0.5 | 5.5 | | — | 0.2 | — |
| Example 16 | 0.04 | 0.10 | 0.04 | 24.2 | 5.7 | — | 2.4 | 2.2 | 2.9 | | 0.008 | 0.04 | — | — |
| Example 17 | 0.05 | 0.06 | 0.02 | 19.4 | 4.2 | 13.2 | — | 1.3 | 2.9 | — | 0.004 | 0.06 | 0.3 | — |
| Comp. ex. 1 | 0.05 | 0.10 | 0.03 | 19.9 | 6.2 | — | — | 1.9 | 2.8 | — | — | — | — | — |
| Comp. ex. 2 | 0.04 | 0.03 | 0.04 | 11.7 | 5.9 | 12.3 | 1.1 | 2.0 | 3.1 | — | — | — | 1.2 | — |
| Comp. ex. 3 | 0.05 | 0.05 | 0.06 | 19.9 | 5.4 | 12.5 | 1.0 | — | 3.2 | — | 0.002 | — | 0.3 | |
| Comp. ex. 4 | 0.06 | 0.10 | 0.07 | 19.0 | 5.6 | 13.2 | — | 2.1 | 0.2 | — | — | 0.03 | 0.4 | |
| Comp. ex. 5 | 0.05 | 0.09 | 0.02 | 18.9 | 5.9 | 12.1 | 1.0 | 2.1 | 3.1 | | 0.006 | 0.03 | 0.4 | — |
| Comp. ex. 6 | 0.04 | 0.12 | 0.05 | 19.2 | 6.2 | 13.2 | 1.1 | 2.2 | 2.9 | | 0.009 | — | 0.3 | — |
| Comp. ex. 7 | 0.08 | 0.05 | 0.02 | 19.9 | 5.8 | 12.2 | 0.9 | 1.9 | 3.2 | | — | 0.06 | 0.4 | — |
| Comp. ex. 8 | 0.05 | 0.09 | 0.02 | 18.9 | 5.9 | 12.1 | 1.0 | 2.1 | 3.1 | | 0.006 | 0.03 | 0.4 | — |
| Comp. ex. 9 | 0.04 | 0.12 | 0.05 | 19.2 | 6.2 | 13.2 | 1.1 | 2.2 | 2.9 | | 0.009 | — | 0.3 | — |
| Comp. ex. 10 | 0.08 | 0.05 | 0.02 | 19.9 | 5.8 | 12.2 | 0.9 | 1.9 | 3.2 | | — | 0.06 | 0.4 | — |
| Comp. ex. 11 | 0.07 | 0.01 | 0.01 | 19.1 | 2.9 | — | — | 0.5 | 0.9 | 5.1 | — | — | 18.5 | — |

| | Others (Impurities) | Cooling rate K/sec. | Vickers hardness Hv | Longitudinal elastic modulus kN/sq · mm |
|---|---|---|---|---|
| Example 1 | Ca: 0.02 Mg: 0.03 | 55 | 461 | 178 |
| Example 2 | | 55 | 499 | 191 |
| Example 3 | O: 0.03 | 55 | 476 | 176 |
| Example 4 | | 55 | 438 | 184 |
| Example 5 | | 80 | 470 | 185 |
| Example 6 | | 80 | 476 | 185 |
| Example 7 | | 55 | 466 | 191 |
| Example 8 | Ca: 0.03 Mg: 0.02 | 55 | 459 | 178 |
| Example 9 | N: 0.02 O: 0.03 | 23 | 446 | 185 |
| Example 10 | | 55 | 469 | 177 |
| Example 11 | N: 0.01 O: 0.02 | 55 | 483 | 174 |
| Example 12 | | 55 | 444 | 171 |
| Example 13 | | 80 | 334 | 156 |
| Example 14 | H: 0.01 | 55 | 421 | 176 |
| Example 15 | | 55 | 490 | 184 |
| Example 16 | | 250 | 396 | 190 |
| Example 17 | | 55 | 404 | 176 |
| Comp. ex. 1 | | 55 | 309 | 145 |
| Comp. ex. 2 | | 55 | 550 | 203 |
| Comp. ex. 3 | | 55 | 453 | 183 |
| Comp. ex. 4 | | 55 | 435 | 180 |
| Comp. ex. 5 | | 55 | 461 | 178 |
| Comp. ex. 6 | | 55 | 499 | 191 |
| Comp. ex. 7 | | 55 | 476 | 176 |
| Comp. ex. 8 | | 2 | 553 | 186 |
| Comp. ex. 9 | | 2 | 552 | 205 |
| Comp. ex. 10 | | 2 | 581 | 192 |
| Comp. ex. 11 | | 2 | 555 | 182 |

[Examples of Heat-resistant Alloy Spring]

In order to evaluate the spring property after the coiling, respective alloy wires subjected to the above-mentioned processes till the above-mentioned solution heat treatment were prepared additionally. And these were subjected to pickling treatment with a mixed solution of hydrofluoric acid and nitric acid or a mixed solution of hydrofluoric acid and sulfuric acid, and subsequently dipped in a Nickel sulfamate bath so as to plate with Ni having a thickness of 5 micrometers.

In the alloy wire plated with Ni, in the same way as in [Examples of Ni-based alloy wire], the lubricant coating comprising potassium sulfate and calcium sulfate as the major components, was applied to the surface of the wire material as the auxiliary lubricant. Then, by the use of a sintered diamond dies, the final cold wiredrawing was carried out with a rate of work of 30% and a finish diameter of 2.4 mm, in the same way as described above, As to the surface condition after the final wiredrawing, each of the alloy wires excelled in the plate adhesion, and the surface roughness Rz was 0.5 to 3.2 micrometers. AS to other properties, almost same results as in [Examples of Ni-based alloy wire] were obtained.

Then, to evaluate the coiling property of this Ni plated alloy wire, a helical compression spring having a coil circle diameter of 18.5 mm, an effective winding number of 4.5, and a free length of 45 mm was formed. The processing was executed using a coiling machine (made by Shinko Machinery Co., Ltd.) without problems.

Each coil spring obtained in this way was subjected to an aging heat treatment as shown in Table 2 to heighten the spring property.

In each of Examples, the aging heat treatment was made so that temperature T(k)×time t(Hr) became within a range of from 1000 to 10000. In Comparative examples 5 to 7, the conditions were changed in order to see the effect of the change in the heat treatment temperature T and the heat treatment time (t).

As in the same way as the wire material, a part of the obtained coil spring was cut off and implanted into a resin, and the cut end surface was polished. And on the cut end surface, the vickers hardness was measured, and the generation of twin crystals and gamma prime phase was observed with a microscope. The microscopic observation was carried out after the cut end surface was etched and the crystal structure became visualized.

As to the twin crystal, the incidence rate thereof was measured. By setting the measuring target at crystals of not less than 10 micrometers, the total number Ns was counted, then the number of twin crystals Ns among them was counted, and a twin incidence rate (Nc/Ns)×100 was obtained. The results are shown in Table 2.

In the results, the alloy wires related to the present invention each had many twin crystal grains, and the incidence rate thereof was not less than 30%.

Incidentally, in order to observe the twin crystals, there was used a micrograph of the cut end surface taken by a 200 times power optical microscope after dipping the cut end surface in the etching solution comprising ethanol, hydrochloric acid and cupric chloride.

In the case of the gamma prime phase, on the other hand, it is possible to use the same etching solution as in the above-mentioned twin crystal, but in this example, using sulfuric acid and liquid methanol, electrolytic etching was carried out. And using a field emission type scanning electron microscope (FE-SEM), the observation was made at 50,000 to 100,000 magnifications.

In each of the Examples, the gamma prime phase having a grain diameter of not less than 25 nanometers (25 to 79 nanometers) on the average was observed, and the above-mentioned hardness and diameter ratio Hv/d was 5.9 to 21.7.

From these facts, it was confirmed that the cooling rate of the wire material during the final solution heat treatment affects the wiredrawing workability and the mechanical properties of the wiredrawn alloy wire, and further the cooling rate is important in terms of the amount of twin crystals generated.

In Examples, it was confirmed that setting the cooling rate of 5 to 100 K/sec., desirably 10 to 70 K/sec., is effective for the sufficient wiredrawing workability; hardness and longitudinal elastic modulus for the wire material; hardness after formed into the spring; and generation of twin crystals. Further, it was also confirmed that an additional application of the aging heat treatment is effective for the formation of the above-mentioned gamma prime phase.

Moreover, the thermal fatigue performances of the springs were evaluated. Since the springs of the present embodiment were a helical compression spring, the following compression test was carried out. In the test, the load loss of each of the springs was obtained, wherein the spring was: compressed with a strain corresponding to a striction strain of 600 MPa; fixed in a jig to keep the compressed length; heated at a temperature of 700 deg.C. for 100 hours, and thereafter took off from the jig to allow its free expansion; recompressed down to the same length as the above-mentioned compressed length at the striction strain of 600 MPa to obtain a spring load thereat; and from this spring load and a spring load first required for the same compressed length before being heat-set, the difference therebetween was obtained as the load loss. The smaller load loss means that the fatigue resistance is better. The results are shown in Table 2.

In the case of Examples, it was confirmed that, owing to the adjustment of the grain diameter of the above-mentioned gamma prime phase and the Hv hardness therefor, each of the load losses became 40 to 47%, i.e., much smaller than 64 to 74% in the comparative examples, so Examples had a favorable spring properties even in high temperatures. Accordingly, it was confirmed that the Ni-based alloy wire in accordance with the present invention provides excellent spring performance in high-temperature environments, e.g., over 700 deg.C.

TABLE 2

| | Temperature T (K) | Heat treatment time (t) (hr) | T × t | Nc/Ns (%) | Vickers Hardness Hv (HV) | gamma prime grain diameter (d) (nm) | Hv/d | Load loss (%) |
|---|---|---|---|---|---|---|---|---|
| Example 1 | 1000 | 2 | 2000 | 42 | 490 | 32 | 15.3 | 41.9 |
| Example 2 | 1050 | 2 | 2100 | 48 | 514 | 35 | 14.7 | 41.7 |
| Example 3 | 1100 | 2 | 2200 | 43 | 507 | 36 | 14.1 | 41.1 |
| Example 4 | 1150 | 4 | 4600 | 44 | 476 | 58 | 8.2 | 42.0 |
| Example 5 | 950 | 10 | 9500 | 47 | 543 | 25 | 21.7 | 43.9 |
| Example 6 | 1000 | 2 | 2000 | 43 | 498 | 28 | 17.8 | 43.4 |
| Example 7 | 1050 | 4 | 4200 | 48 | 480 | 43 | 11.2 | 41.9 |
| Example 8 | 1100 | 8 | 8800 | 42 | 495 | 51 | 9.7 | 40.6 |
| Example 9 | 1150 | 8 | 9200 | 43 | 473 | 73 | 6.5 | 42.4 |
| Example 10 | 1150 | 1 | 1150 | 46 | 494 | 56 | 8.8 | 42.9 |
| Example 11 | 1000 | 8 | 8000 | 48 | 512 | 45 | 11.4 | 42.0 |
| Example 12 | 1050 | 6 | 6300 | 42 | 480 | 51 | 9.4 | 42.3 |
| Example 13 | 1150 | 8 | 9200 | 40 | 461 | 78 | 5.9 | 45.5 |
| Example 14 | 1200 | 1 | 1200 | 43 | 465 | 59 | 7.9 | 43.5 |
| Example 15 | 1150 | 6 | 6900 | 67 | 505 | 45 | 11.2 | 41.9 |
| Example 16 | 1100 | 6 | 6600 | 44 | 456 | 29 | 15.7 | 43.2 |
| Example 17 | 1000 | 8 | 8000 | 41 | 466 | 26 | 17.9 | 47.1 |
| Comp. ex. 1 | 1000 | 2 | 2000 | 32 | 385 | 8 | 48.13 | 73.2 |
| Comp. ex. 2 | 1050 | 2 | 2100 | 31 | 574 | 11 | 52.18 | 66.5 |

TABLE 2-continued

| | Temperature T (K) | Heat treatment time (t) (hr) | T × t | Nc/Ns (%) | Vickers Hardness Hv (HV) | gamma prime grain diameter (d) (nm) | Hv/d | Load loss (%) |
|---|---|---|---|---|---|---|---|---|
| Comp. ex. 3 | 1100 | 2 | 2200 | 33 | 472 | 12 | 39.33 | 67.7 |
| Comp. ex. 4 | 1150 | 2 | 2300 | 37 | 455 | 18 | 25.28 | 64.4 |
| Comp. ex. 5 | 900 | 1 | 900 | 30 | 462 | 12 | 38.5 | 68.2 |
| Comp. ex. 6 | 1200 | 14 | 16800 | 31 | 483 | 110 | 4.4 | 67.2 |
| Comp. ex. 7 | 1150 | 20 | 23000 | 30 | 480 | 118 | 4.1 | 64.4 |
| Comp. ex. 8 | 1000 | 2 | 2000 | 20 | 561 | 16 | 35.06 | 69.8 |
| Comp. ex. 9 | 1050 | 2 | 2100 | 23 | 583 | 18 | 32.39 | 68.1 |
| Comp. ex. 10 | 1100 | 2 | 2200 | 18 | 592 | 19 | 31.16 | 71.5 |
| Comp. ex. 11 | 950 | 8 | 7600 | 16 | 575 | 13 | 44.2 | 72.1 |

The invention claimed is:

1. A heat-resistant alloy spring made of a Ni-based alloy material which is a wire material having a wire diameter of not more than 4 mm, said Ni-based alloy material comprising in weight %:

not more than 0.1% C;

not more than 1.0% Si;

not more than 1.50% Mn;

13.0 to 25.0% Cr;

5.5 to 7.0% Mo;

0.5 to 4.0% Ti;

0.1 to 3.0% Al;

12.0% to 18.0% Co;

at least one optional element selected from the group consisting of 0.15 to 2.50% W, 0.001 to 0.020% B, 0.01 to 0.3% Zr, 0.30 to 6.00% Nb, and 0.03 to 2.00% Cu;

the balance being essentially Ni; and incidental impurities, wherein said Ni-based alloy material has in its crystal structure crystals which have gamma prime phase [$Ni_3$(Al, Ti)] or gamma prime phase [$Ni_3$(Al, Ti, Nb)] and twin crystals, the gamma prime phase having an average grain diameter (d) of not less than 25 nanometers, and wherein a hardness-diameter ratio (Hv/d) of the average grain diameter (d) (nanometer) and a Vickers hardness Hv measured at a certain depth from a surface of the Ni-based alloy material being 5 to 25 and said certain depth is one-fourth of the wire diameter, and when crystal grains having grain diameters of not less than 10 micrometers are counted in a field of observation view, the percentage Nc/Ns of the total count Ns of the crystal grains and the count Nc of twin crystal grains is not less than 30%.

2. The heat-resistant alloy spring of claim 1, wherein said Ni-based alloy material comprises in weight %:

not more than 0.08% C;

not more than 0.50% Si;

not more than 0.50% Mn;

16.0 to 22.0% Cr;

12.0 to 14.0% Co;

5.5 to 7.00% Mo;

2.50 to 4.00% Ti;

1.50 to 3.00% Al;

and at least one of 0.50 to 2.50% W, 0.001 to 0.020% B and 0.01 to 0.30% Zr.

3. The heat-resistant alloy spring of claim 1 or 2, wherein the average grain diameter (d) of the gamma prime phase is 30 to 80 nanometers, and the gamma prime phase exists compactly in crystal grains of an austenite phase matrix.

4. The heat-resistant alloy spring of claim 1, wherein the spring is subjected to shaping into the spring and thereafter an aging heat treatment, the aging heat treatment being conducted at a temperature T (K) of not less than 1000, such that a product of said temperature T (K) and a heat treatment time t(hr) is in a range of more than 1000 and less than 10000.

5. The heat-resistant alloy spring of claim 1, wherein the spring is used for an exhaust valve of an automobile engine.

6. A Ni-based alloy wire having a wire diameter of not more than 4 mm and used as the Ni-based alloy material of the heat-resistant alloy spring of claim 1, wherein the alloy wire is made of a Ni-based alloy comprising in weight %:

not more than 0.1% C;

not more than 1.0% Si;

not more than 1.50% Mn;

13.0 to 25.0% Cr;

5.5 to 7.0% Mo;

0.5 to 4.0% Ti;

0.1 to 3.0% Al;

12.0 to 18.0% Co;

at least one optional element selected from the group consisting of 0.15 to 2.50% W, 0.001 to 0.020% B, 0.01 to 0.3% Zr, 0.30 to 6.00% Nb, and 0.03 to 2.00% Cu;

the balance being essentially Ni; and incidental impurities, wherein the alloy wire is provided with an Hv hardness of 320 to 480 and a longitudinal elastic modulus of 150,000 to 230,000 N/sq·mm and a crystal structure such that, when crystal grains having grain diameters of not less than 10 micrometers are counted in a field of observation view, the percentage Nc/Ns of the total count Ns of the crystal grains and the count Nc of twin crystal grains is not less than 30% by heating at a temperature of 900 to 1200 deg.C. for 10 to 1000 seconds, then subjecting to a solution heat treatment to cool down at a rate of 5 to 300 deg.C./sec, and cold wiredrawing.

7. The Ni-based alloy wire of claim 6, wherein said incidental impurities include at least one of Ca, Mg, N, O or H with weight % controlled as follows, Ca: not more than 0.05%, Mg: not more than 0.05%, N: not more than 0.10%, O: not more than 0.10%, and H: not more than 0.01%.

8. The Ni-based alloy wire of claim 6 or 7, wherein the wire surface is coated with nickel Ni having a Ni concentration gradient reducing from said surface toward the inside of the Ni-based alloy wire.

* * * * *